United States Patent [19]

Svensson

[11] 4,326,365

[45] Apr. 27, 1982

[54] JOINT SYSTEM FOR WALLS, DOORS AND THE LIKE

[75] Inventor: Gunnar Svensson, Jönköping, Sweden

[73] Assignee: AB Svenska Flaktfabriken, Nacka, Sweden

[21] Appl. No.: 115,025

[22] Filed: Jan. 24, 1980

Related U.S. Application Data

[63] Continuation of Ser. No. 884,852, Mar. 9, 1978, abandoned.

[30] Foreign Application Priority Data

Mar. 10, 1977 [DE] Fed. Rep. of Germany ..... 207/77[URA]

Mar. 10, 1977 [SE] Sweden ..... 7702695

[51] Int. Cl.[3] ..... E04C 2/38; E04D 1/36

[52] U.S. Cl. ..... 52/204; 52/285; 52/393; 52/471; 52/582

[58] Field of Search ..... 52/285, 469, 470, 471, 52/465, 582, 404, 406, 204, 211, 393; 312/257 R, 257 SM

[56] References Cited

U.S. PATENT DOCUMENTS

| | | | |
|---|---|---|---|
| 3,381,438 | 5/1968 | Bohnsack . | |
| 3,548,557 | 12/1970 | Downing | 52/461 |
| 3,594,028 | 7/1971 | Scott | 52/471 |
| 3,854,261 | 12/1974 | Frei | 52/404 |

*Primary Examiner*—John E. Murtagh

*Attorney, Agent, or Firm*—Dann, Dorfman, Herrell & Skillman

[57] ABSTRACT

A joint system for structural panels in which the panels have an edge construction providing a U-shaped profile having a side leg spanning between the opposite surfaces of the panel, a base coplanar with one of the surfaces and a clamp leg having an inwardly projecting portion. The panels are interconnected by cover strips of U-shaped cross section having a body adapted to overlie the clamp legs of the adjoining panels. At the opposite side edges of the body, arms extend inwardly and mount locking strips which extend toward the center of the body and are adapted to engage with the inwardly projecting portions of the profile to permit the panels to be connected in endwise alignment, at right angles, or in back-to-back relation. The patent specification discloses several different configurations of the U-shaped construction and several different configurations for the cover strips.

12 Claims, 12 Drawing Figures

FIG. 3
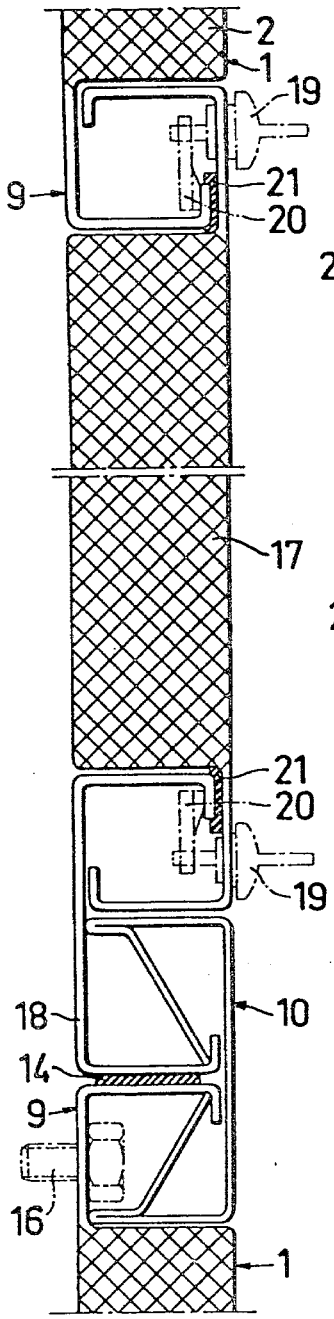
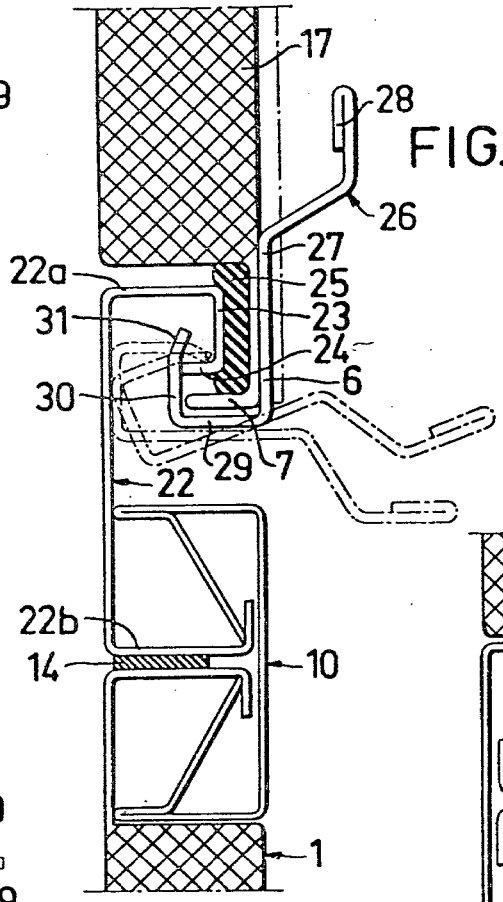
FIG. 4
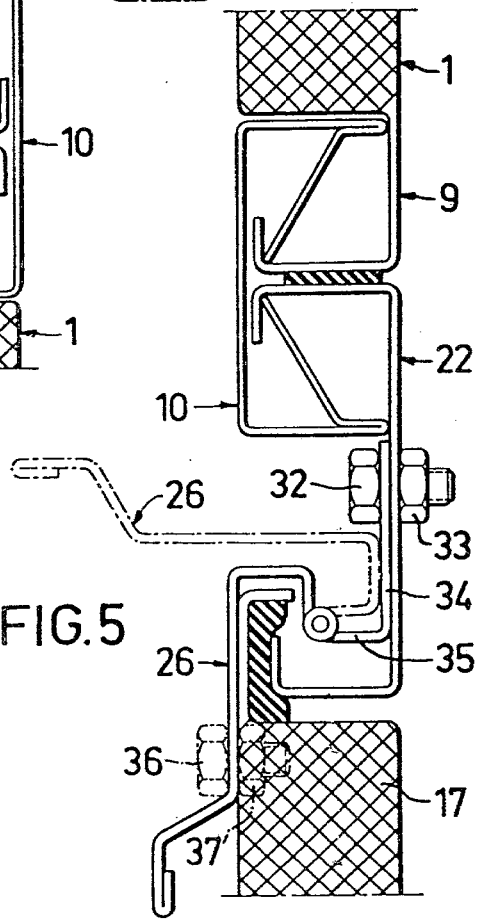
FIG. 5

JOINT SYSTEM FOR WALLS, DOORS AND THE LIKE

This is a continuation of application Ser. No. 884,852 filed Mar. 9, 1978, now abandoned.

This application is related to my earlier design application Ser. No. 831,890 filed Sept. 9, 1977 for "Structural Panel Design" now abandoned.

The present invention concerns a joint system for walls, doors and the like, which are composed of structural panels, and joint or cover strips cooperating with the profile of the panel edge construction.

It has for a long time been known to design or provide wall modules and the like with special, extruded edges which cooperate with correspondingly designed edges of adjacent modules and/or with special joint strips. Examples of these are disclosed in U.S. Pat. Nos. 2,259,382 and 2,394,702; Swiss Pat. Nos. 505953 and 523392; Sweden Pat. Nos. 303579 and 369090; German Pat. Nos. 1658857 and 2258053; French Pat. No. 2001590; and Norway Pat. No. 133597. In principle, it is consequently possible with these known joint systems to join in planar direction and in certain cases even in varying angles, a number of wall sections, panels or the like together to form a unit of desired size and appearance.

While the principle itself of being able to join together in this manner identical or similar sections to form a unit of desired form and appearance is advantageous, these previous joint systems are marred by a plurality of weighty disadvantages, which result in that the previously proposed solutions often have only theoretical value or are applicable only for certain special cases. Consequently, certain proposals are applicable solely for joints in planar direction, i.e. joints where the panels are disposed edge-to-edge in planar alignment. If one wishes to branch out intermediate or end walls, one has to use other joint extrusions and/or design at least one of the meeting edges differently from those used in connection with planar directional joining. This, of course, complicates assembly and reduces the value of the method of joining. Another weighty disadvantage is in certain cases that the joint edges formed on wall modules are not satisfactorily integrated or attachable to the respective modules or the like. In such cases, the joint connection can easily loosen, perhaps resulting in an entire wall or an entire unit needing to be disassembled in order to repair a faulty joint connection. Another weighty disadvantage is present in almost all previously known joint systems in that the joint edges and/or with these cooperating joint profiles or strips are too flexible or pliably designed to give a connection which is too flexible or pliable resulting in that an unstable construction is obtained which is not capable of withstanding any substantial strains. And lastly, most of the joint systems are marred by the disadvantage that the joint is much too complicated in its construction and/or function, whereby one obtains on the one hand an expensive product and on the other hand a complicated assembly operation, for which trained personnel are often required, not to mention that the complicated constructions of the joint can enable minor damage in the units to occur easily or that close tolerances can result in that many and expensive units have to be discarded since a connection is no longer possible. Many of the previously known joint systems are also unusable when gas-tight connections are desired.

The objective of the present invention is primarily to overcome the above-stated disadvantages and as such as possible to eliminate them. A further object of the invention is to advance technology in this entire field. The invention has as a particular object to attain these purposes in the form of a simple, inexpensive and versatile construction.

These objects are achieved according to the invention by an improved joint system of the stated type which mainly is characterized as a novel edge construction for the structural panels and an improved joint or cover strip cooperating with the profile of the edge construction.

Further features and advantages of the invention are revealed by the following description with reference to the accompanying drawings, in which:

FIG. 3 is a fragmentary cross-sectional view showing in principle the same joint system applied to a panel having an inspection door or the like for installation between two wall panels or the like, two such panels being shown;

FIG. 4 is a cross-sectional view showing a minor modification of the lock mechanism of the door of FIG. 3;

FIG. 5 is a fragmentary cross-sectional view showing an alternative to the lock mechanism of the door according to FIG. 4;

Figure 1:
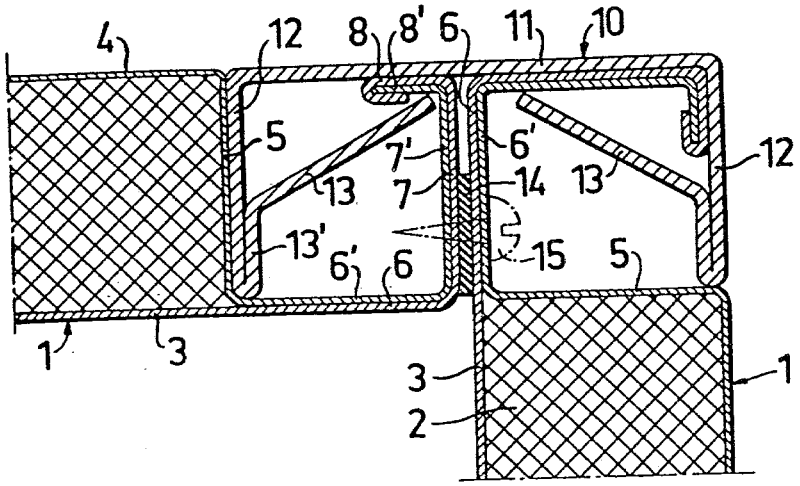
FIG. 1 is a cross-sectional view showing a first example of a joint system according to the invention with wall panels arranged at right angles.

In the drawing, 1 designates in its entirety a wall panel which can be designed and applied in an arbitrary way. Its applicability can consequently be directed towards external walls, intermediate walls and ceilings to mention only a few examples. Even uses can be considered, where one would not speak of pronounced walls or ceiling panels. These units can consequently be in whole or in part of practically any construction. Even the construction can, of course, vary and be arbitrary. In cases shown, the wall panels consist of a core 2 of e.g. rigid cellulose plastic with heat insulation properties. This core is surrounded by metal plate forming the flat sides 3 and 4, as well as the short sides 5. In a preferred embodiment, one metal plate forms the one flat inner side 4 and at least one short side leg 5, that is to say, the plate is bent from the flat side 4 to form this short side leg in order to afterwards meet the other flat outer side 3. However, seen in direction of the profile, the plate does not end there either; the flat side 3 is instead lengthened in the same planar direction to form a joint stage or base 6, which, at a given distance from the short side leg 5, is bent inward at a 90° angle in plane, parallel relation to the short side leg 5 and located opposite the same, in the form of a clamp leg 7, which immediately before having reached the geometrical plane of the flat side 4, is bent in direction toward and in plane, parallel relation to this flat side 4 in form of a shorter terminal foot 8. The metal plate, which forms the short side leg 5, and preferably even the flat side 4, follows coextensively the inner side of the joint base 6, the clamp leg 7 and the terminal foot 8 while bearing tightly and evenly against these, as indicated at 6', 7' and 8'. After completed assembly, the outer terminal foot 8, that is to say that which originally extends from the flat side 3, is bent around the inner terminal foot 8', which originally extends out away from the flat side 4, respectively the short side 5. In this manner, a rounded edge is obtained, which moreover becomes more stable and more capable of resisting strains, such as e.g. bending upwards. For the sake of simplicity, the plate elements, which extend out from the short side 5 and the flat side 4, have been given the primed designations corresponding to the elements extending from the flat side 3. The short side leg 5, both of the joint bases 6,6', both of the clamp legs 7,7' and both of the terminal feet 8,8' are designated hereafter as edge profiles or U-shaped edges 9.

Figure 2:
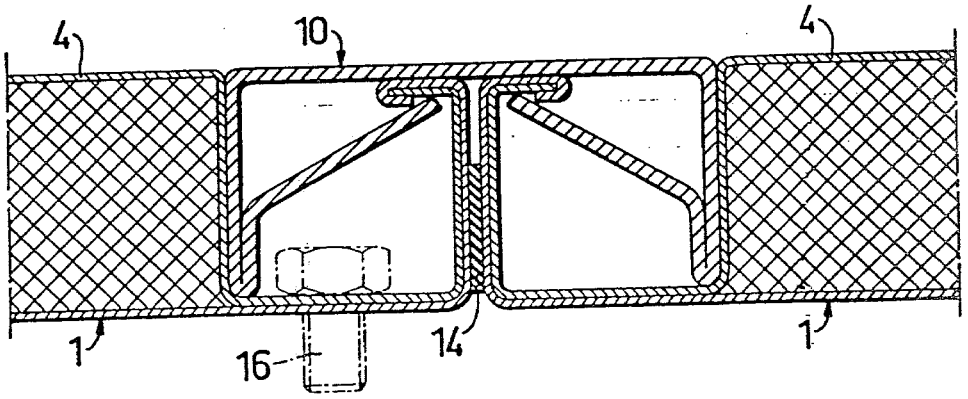
FIG. 2 is a cross-sectional view of the same joint system and the same wall panels which, in this case, are arranged in planar alignment.
Figure 6:
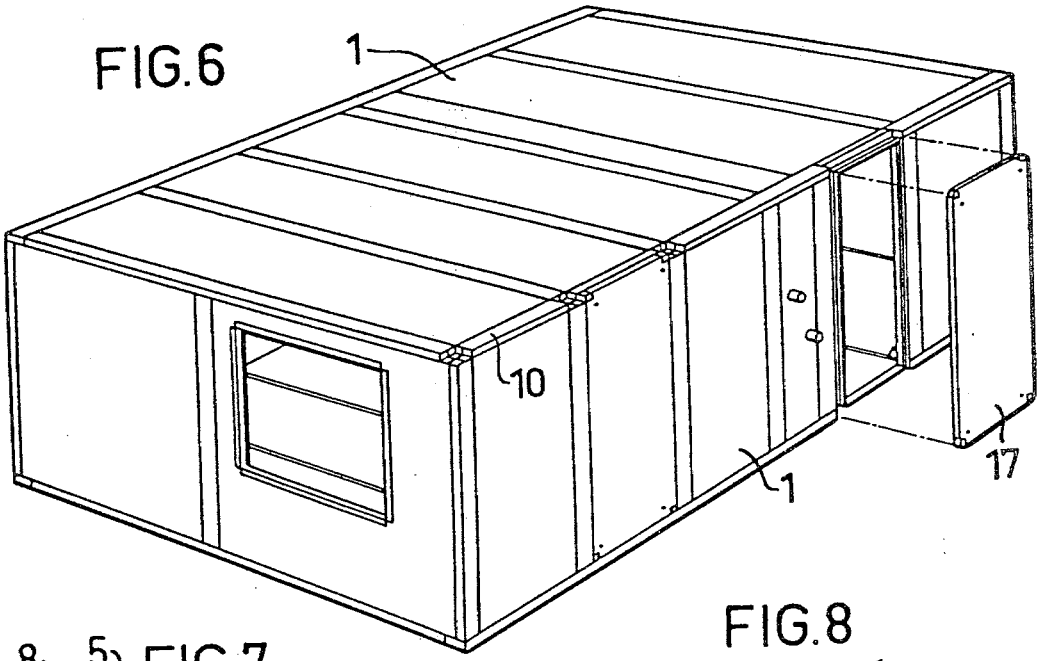
FIG. 6 is a perspective view of an assembled unit with joint systems according to the invention.

The edge profile can, of course, also be designed in another way, e.g. by means of only one of the plates being formed into such profile or by means of a completely separate profiled joint element being attached to each wall unit 1. Such a separate profiled joint element would then consist of a terminal foot, a clamping leg, a base and a whole or partial short side leg 5 and/or flat side 3. Fastening in a wall panel 1 can occur by means of screws and/or rivets and/or gluing or in another way. One can, of course, also conceive an embodiment wholely or partially of plastic instead of an embodiment of metal plate. If double bases, clamping legs and terminal feet as shown in FIGS. 1 and 2 are used, these parts can, if so desired, be glued to one another, which, however, is not necessary, since such a construction becomes very stable in any case. Welding together of the same is also possible.

Wall or ceiling panels or module units of another type can on one or several, preferably all sides, be provided with the edge profiles described above and shown in the drawing figures, which profiles are all suitably turned in the same direction.

As revealed in FIGS. 1 and 2, two wall panels which are adjacent to one another and provided with edge profiles or U-shaped edges, can butt against one another either at a right angle in planar relation, and only one and the same joint cover strip 10 comes into use. The U-shaped edges form a guideway between the short side 5 and the feet 8 along the entire length of the panel edge to slidably receive the strip 10. This consists of a relatively flat U-shaped profile with an extended body portion 11 and arms 12. In this connection, "relatively flat" means that the body portion has approximately double the extension of the arms 12, which, however, is only to be construed as a practical embodiment. Within the area for their free ends or edges, the arms 12 take on the form of locking strips 13 designed to extend substantially diagonally across the guideway formed by the U-shaped edges or profiles 9 so that its terminal ends or edges abut the profiles within the corner transition between the clamping legs 7 and the terminal feet 8. An alternate embodiment of strips 10 is shown in FIGS. 7 and 8 where the locking strips extend out straight from the free end or edges of the arms 12 substantially diagonally to its terminal end or edge which abuts between the clamping leg and the terminal foot of the profile.

Figure 7:
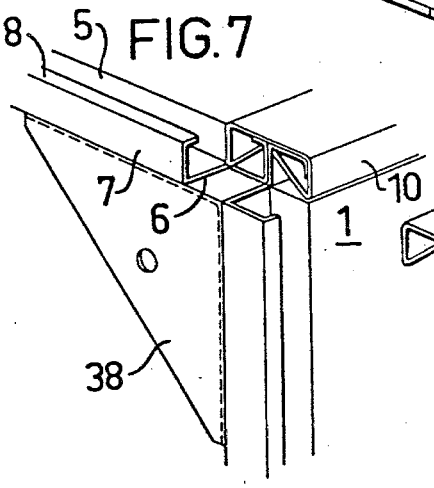
FIG. 7 is a fragmentary perspective view showing an upper external corner junction of the unit shown in FIG. 6.
Figure 8:
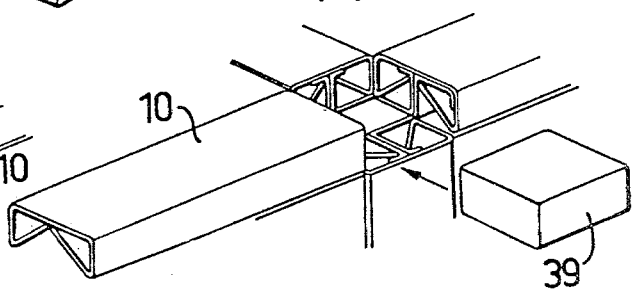
FIG. 8 is a fragmentary perspective view showing an upper junction of the unit shown in FIG. 6 when assembling a floating wall panel within the area for providing an intermediate partition wall.

In FIGS. 1–5, however, the joint cover strips 10 have locking strips 13 with shoulders 13' extending back parallel with the arms 12 and preferably bearing tightly against the arm for a given distance from the transition before being bent at an angle, e.g. 60° relative to the arms 12, substantially to project diagonally and end within the same corner as the locking strips 10 in FIGS. 7 and 8.

As revealed by the different drawing figures, depending on the nature of the connection between adjoining wall panels, the free edges of the locking strips 13 extend into the corner between either the terminal feet 8,8' and the clamping legs 7,7' or the latter and the joint bases 6,6', as is clearly revealed by FIG. 1, where two wall units are connected to one another in a right angle. The strips 13 may butt against either the foot, the leg, or the base, or neatly in the junction between them. As revealed by FIGS. 1 and 2, one can by means of a joint strip 10, according to the invention, in one and the same embodiment arbitrarily connect wall units to one another in planar direction or at e.g. 90° angle. This is a very great advantage and it simplifies assembly and stocking as well as manufacturing costs enormously.

Owing to that the outer sides of the terminal feet rest a predetermined distance inside the outer side of the flat side 4 and in a plane parallel thereto, preferably corresponding to the thickness of the body portion 11 and arms 12, completely flat transitions between panels connected to one another are thusly obtained, as revealed in the drawing figures.

To obtain a gas-tight connection between units, it can be advantageous to place a sealing strip or gasket 14 between the elements of the adjoining joint profiles 9 that are turned toward one another. To guarantee such a sealing effect, lock screws 15 can be introduced through the stated sections and through the sealing strip 14 (see FIG. 1).

While the design of the locking strips 13 of the cover strip 10 according to FIGS. 7 and 8 are simpler, certain important advantages can be obtained with the strip 10 having a shoulder 13'. Owing to such a shoulder, it is namely possible or easier to anchor within the space between the joint stages 6,6' and the clamp legs 7,7', e.g. a retaining screw 16, or a nut which cooperates with the screw whose head otherwise would not fit within this space. But even the elastic properties of the locking strips 13 can be effected in this way. The angle between the locking strips 13 and the body portion 11 become somewhat more acute so that a greater elastic effect is obtained. Furthermore, the shoulders 13' of the locking strips can be united in a suitable manner with the arms 12 partly to attain a more stable construction and partly to, in this way, affect the elastic effect of the locking strips 13.

The joint section according to the invention affords that one can easily fit in removable panels, such as an inspection door or the like 17 shown in FIG. 3 and following. Here one has the capability to fit in such a door directly between two panels 1 having joint profiles 9 which are adjacent but spaced at a distance from one another, or an intermediate frame element can also be used, such as a joint cover strip 10 and a joint double profile 18, as revealed by FIG. 3. The designation "joint double profile" also denotes the character of this profile, which consequently consists of two mirrored symetrically arranged joint profiles. Such a joint double profile can be connected in planar direction as shown in FIG. 3 or also in right angle in a manner similar to that shown in FIG. 1. The door or the like 17 itself is preferably provided with laterally located joint profiles 9 facing oppositely to the profiles of the wall panels, where a knob or the like 19 is anchored in the joint base, which can, e.g. with an eccentric lock washer 20, achieve locking by means of that this washer is arrested behind the terminal foot 8 of the adjoining wall panel, as shown. The sealing strips or gaskets 21 and 14 can here also provide for a gas-tight connection.

In FIG. 4, an alternative to the anchoring of an inspection door or the like 17*a* for the embodiment according to FIG. 3, is shown. Similar to this previous embodiment, a joint strip 10 is connected on one side immediately to a wall unit 1 and on the other side to a modified joint double profile 22. In this embodiment, one has proceeded from the supposition that the inspection doors or the like 17*a* and joint double profiles 22 will be only used according to a certain pattern, so that special design of cooperating parts is not a disadvantage but rather an advantage. Consequently, the door or the like 17*a* is in the already described manner, provided with a joint base 6 and a clamping leg 7 which, however, is considerably shorter than according to the previously described embodiment. Further, within the area for cooperation with the joint strip 10, the modified joint double profile is designed like the profile 18 as shown and described in connection with FIG. 3, but the arm 22*a*, turned toward the door, is somewhat shorter than the other arm 22*b* and has a flange 23 spaced from and parallel to the base 6 of the door profile which has a shortened clamping leg 7*a* at its free end. The flange 23 has a hook lip 24 which is substantially parallel to and approximately at the same level as the leg 7*a*. Lodged between the base 6 and flange 23 there is a sealing strip or gasket 25. Designed and joined in this manner, the sections are held together by a special locking rail 26 which can extend along the entire length of the profile or be divided into shorter pieces, which, with reciprocal distance, are adapted to different levels. The locking rail 26 comprises a base element 27 designed to bear evenly against the outer side of the joint base 6 in locked position. In the direction of the door 17*a*, a handle or the like 28 connects to the base element 27, which handle e.g. is formed by means of bending a plate material, e.g. in a 70° angle, in a direction away from the door 17*a* or the plane of the base 27 in order to end thereafter in form of a handle section parallel to the base 27 which eventually can be double weight. In the other direction, a rail section 29 connects to the base 27 at a 90° angle, which rail section after having gone a distance past the clamping leg 7, goes over in a rail section 30 bent inward at a 90° angle which, in turn, after having gone past the hook lip 24 of the flange 23, is bent somewhat in a direction toward the flange 23, e.g. in a very small angle, preferably at 5°–30°, and forms a locking tongue 31. The manner of action of such a connection is clearly revealed by FIG. 4 where the different positions of the locking rail 26 are drawn partly with broken lines. Assembly and disassembly of a door or the like 17 in this manner becomes very simple, fast and dependable. The design of the various profiles and of the locking rail is very simple and inexpensive. Further, the great advantage is obtained in that one has completely separate sections which do not require any assembly operation as is the case with almost all other locking apparatus.

In FIG. 5, a locking apparatus which is closely related to that shown in FIG. 4, is shown for an inspection door or the like 17*b*. In this case, a locking rail 26*b* is, however, pivotably attached to a joint double profile 22 which is modified by the elimination of the locking lip 24 and the addition of a hinge strap 34 fastened on the inner side of the double profile by means of screw 32 and nut 33. The strap 34 has a hinge section 35 extending inward at right angle, attached to which is the rail 26*b*. In this way, a locking tongue 31 and the hook lip 24 can, of course, in this case, be avoided. Instead of being self anchoring, the rail 26*b* can be arrested at the door 17, e.g. by means of a screw 36 with nut 37 or in another suitable manner which can allow rapid locking as well as rapid opening.

FIGS. 6–10 reveal various possibilities for assembling wall panels by means of a joint system according to the invention. Consequently, one sees in FIG. 6 that a large box-like house section has been able to be assembled including an easily removable inspection door 17 or the like.

Figure 9:
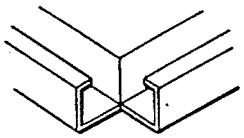
FIG. 9 is a fragmentary perspective view showing one corner of a wall or ceiling panel of the unit shown in FIG. 6.

FIG. 7 reveals the design of an upper corner when combining wall and ceiling panels. An angle bracket or the like 38 is then suitably attached at the top on a joint base 6 of an upright wall panel for supporting an adjoining ceiling panel. A typical corner of the wall and ceiling panel is shown in FIG. 9.

FIG. 8 shows an embodiment comprising a junction between two wall and two ceiling panels. In that connection, an open space may occur between the adjoining joint strip elements, which space can easily be filled in with a block or the like 39. One can, of course, also construct some joint strips with greater length in order to cover over this space, which, however, is not so advantageous.

Figure 10:
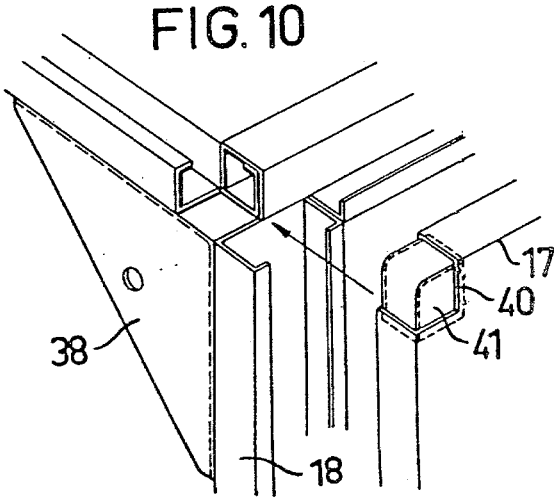
FIG. 10 is a view similar to FIG. 7, showing a panel having an inspection door or the like instead of a wall panel.

FIG. 10 shows the assembly of a ceiling unit with an inspection door 17 instead of a wall unit. In this case, a joint double profile 18 or 22 is consequently used in accordance with any of FIGS. 3–5. The inspection door 17 can be provided with a notch 40 within its corner area, which easily can be filled again by corner blocks 41. In this manner, a gas-tight connection is obtained.

Figure 11:
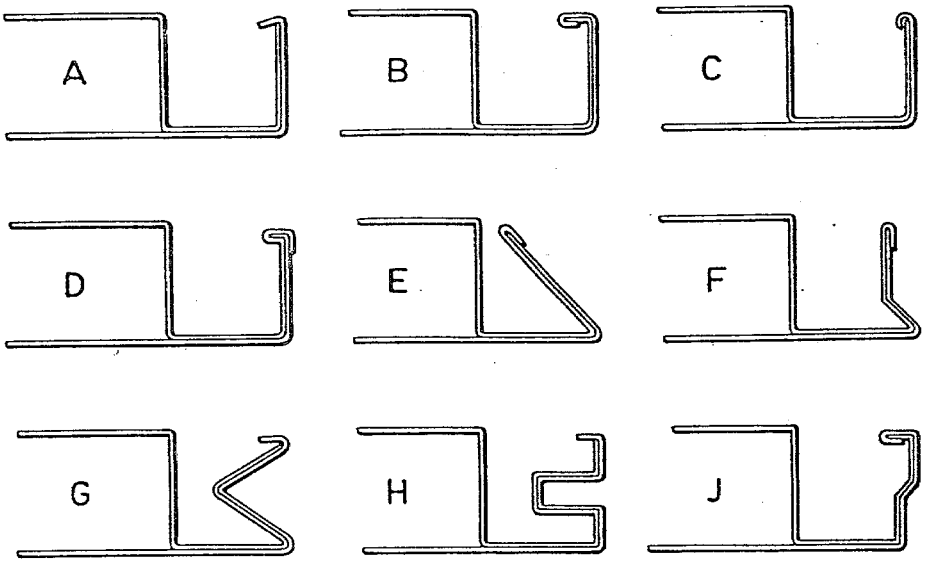
FIGS. 11A through 11J are fragmentary views illustrating alternative profiles for the edge construction of the panels in accordance with the present invention.
Figure 12:
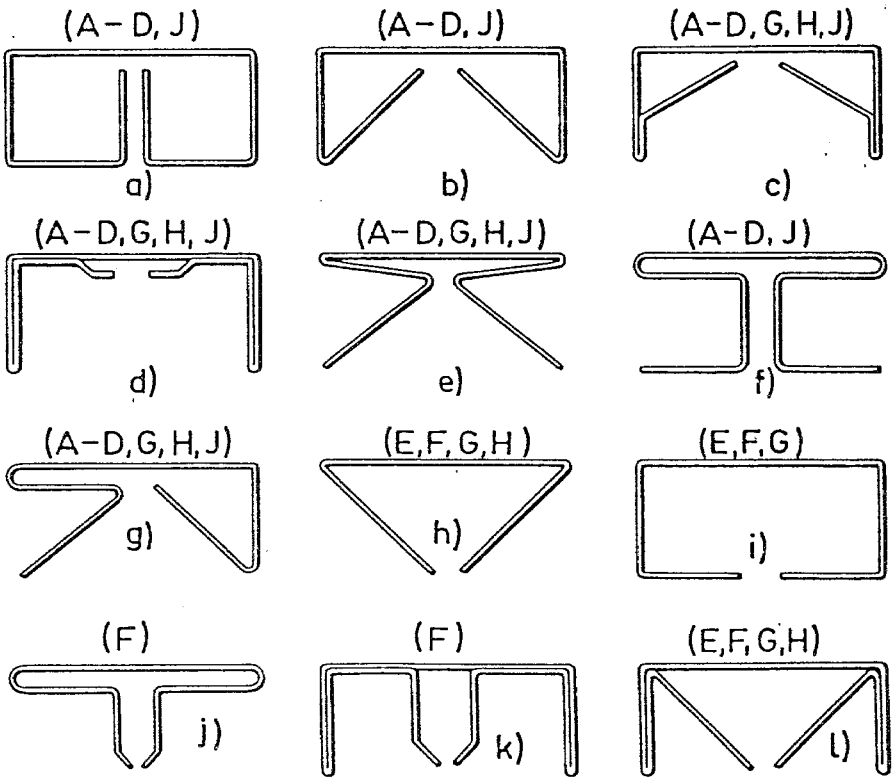
FIGS. 12(*a*) through 12(*l*) are views illustrating alternative profiles for joint or cover strips cooperating with the panel edge construction of FIGS. 11A through 11J.

FIGS. 11 and 12 show alternative embodiments of joint profiles or U-shaped edges and joint cover strips, respectively. The following table shows the joint or cover strips of FIGS. 12*a–j* which may be used with the U-shaped edge profiles of FIGS. 11A–J:

| Joint or Cover Strip | Edge Profile |
|---|---|
| 12a | 11A - D, J |
| 12b | 11A - D, J |
| 12c | 11A - D, G, H, J |
| 12d | 11A - D, G, H, J |
| 12e | 11A - D, G, H, J |
| 12f | 11A - D, J |
| 12g | 11A - D, G, H, J |
| 12h | 11E, F, G, H |
| 12i | 11E, F, G |
| 12j | 11F |
| 12k | 11F |

-continued

| Joint or Cover Strip | Edge Profile |
|---|---|
| 12l | 11E, F, G H |

It should be noted that in FIG. 11, the profile of the edge construction provides a generally U-shaped configuration having a base coplanar with one surface of the panel, a side leg spanning between the opposite surfaces of the panel and a clamping leg disposed in spaced relation to the side leg of the edge construction. In FIGS. 11A–D, G, H, and J, the free end of the clamping leg has a terminal foot projecting toward the structural panel against which the locking strip of the associated joint cover strip may engage. In FIGS. 11E, F and G, the clamping leg projects angularly inwardly adjacent the base to provide a projecting portion for cooperating with a remote edge of the locking strip. In FIG. 11H, the clamping leg has an inwardly offset rectangular projecting portion which may cooperate with the locking strip of the joint cover strip.

The joint cover strips shown in FIGS. 12*a–l* are likewise generally U-shaped in cross section and have body portions constructed and arranged to overlie the clamping legs of the profiles 9. At the opposite edges of the body portion, arms are provided which support locking strips extending inwardly to interlock with the projecting portions of the clamping legs of the edge construction profiles 9. The embodiments of FIGS. 12*a–d, i, k* and *l* provide arms substantially corresponding in length to the side legs of the profile 9 and the locking strips are formed by extending the free ends of the arms to cooperate with projecting portions of the clamp legs of the corresponding profile of FIG. 11. In FIGS. 12*e, f, g, h* and *j*, the arms are bent back at an angle greater than 90° and are merged with the locking strip to perform the interlocking function which is apparent from the foregoing table.

Further specific description of these various embodiments is unnecessary in view of the illustration in FIGS. 11 and 12 and the foregoing table.

As revealed in the different figures, with help of joint systems according to the invention, a self-supporting construction is obtained, out of which individual panels can easily be removed or replaced without affecting the construction otherwise. Although no example has been illustrated, it is, of course, very easily possible to even join together several panels one above the other. With help of a joint system according to the invention, it is, of course, possible to connect two wall panels back to back, e.g. in that the lefthand panel in FIG. 1 is turned one-quarter of a revolution counterclockwise so that the flat sides bear against one another.

Strictly speaking, no tools at all are needed for assembling or disassembling of the panels provided with joint sections according to the invention. If a tighter fitting is desired, it is sufficient to use a suitable pounding tool, e.g. a wooden club or mallet. In connection with the construction of FIG. 4, a special advantage can also be mentioned in that the rail 26 can never fall off since it is retained in all positions by the hook lip 24.

The embodiments described above and shown in the drawing figures are only to be considered as non-limiting examples which can be modified and supplemented at will within the scope of the inventive idea and the following claims.

I claim:

1. A joint system for first and second structural panels, each panel having spaced opposite side wall surfaces, at least one edge of each panel being constructed as a U-shaped edge, and a joint strip designed to cooperate with two adjacent edges of said first and second panels, said joint strip having a relatively flat U-shaped cross section which grips around said two adjacent U-shaped edges and locks these to one another, characterized in that each U-shaped edge comprises a short side leg spanning between the opposite surfaces of the panel, a base extending outward at a right angle from one edge of said side leg, and a clamp leg spaced apart and parallel to the short side leg extending from said base and terminating in a projecting portion which is shorter than said base and bent in toward the short side leg, said short side leg, base and clamping leg being of approximately the same width, said projecting portion being located in a plane parallel to and inside the plane of the adjacent side wall surface by a predetermined distance, said short leg, base, clamp leg and projecting portion forming a generally square guideway between said clamp leg and said short side leg, said guideway extending along the length of said one edge of the panel and being open between said projecting portion and the short side leg to slidably receive the joint strip, and each joint strip comprises a body portion of a thickness corresponding to said predetermined distance, and a width corresponding to twice the width of said base, arms extending perpendicular to said body and at the opposite edges thereof, said arms being approximately one-half of the width of the body and substantially the same width as said short side leg so that when the joint strip is in place within the guideway of one of said panel edges, the outer surface of the body portion is substantially coplanar with the adjacent side wall surface and one arm projects into the guideway alongside said side leg, and locking strip means extending toward the central area of the body portion, the arm and locking strip means at each edge of the body portion being designed to slide longitudinally within the guideway of one U-shaped edge, each locking strip being of a width that the opposite edges of said locking strip are slidable longitudinally in the guideway between said short side leg and said clamp leg to retain the one panel edge in its location relative to the adjacent panel edge.

2. A joint system according to claim 1, characterized in that at least a portion of said U-shaped edge is integral with at least one of the opposite sidewall surfaces of the related panel, said one sidewall surface consisting of metal plate, said plate being extended and bent to form said U-shaped edge.

3. A joint system according to claim 2, wherein both sidewall surfaces of said panel comprise metal plates, characterized in that both metal plates are bent together to form the base and the clamp leg of the U-shaped edge, the outside plate being bent around the inside plate within the area of the projecting portion.

4. A joint system according to claim 2, wherein both sidewall surfaces of the panel comprise metal plates, said U-shaped edge being formed by two metal plates disposed flush together and connected to one another.

5. A joint system according to claim 1, characterized in that the locking strip has shoulders extending parallel against the inner sides of the arms of the joint strip, and then extend toward the central area of the body.

6. A joint system according to claim 1, characterized in that the locking strips comprise flat strips extending substantially diagonally from said arms to at least one of said base, said clamp leg and said projecting portion.

7. A joint system according to claim 1, characterized in that the guideway within the short side leg, the base and the clamp is sufficient to accommodate both fastening members for anchoring other members on the panel, and said locking strip along with fastening members.

8. A joint system according to claim 1, wherein said structural panel comprises an inspection door, and at least one fastening means mounted in the base of one U-shaped edge thereof for cooperation with the U-shaped edge of an adjoining panel to releasably secure the inspection door panel in place.

9. A joint system according to claim 1, characterized by including a filler frame between said panels, the second panel comprising an inspection door, said filler frame consisting of a double U-shaped edge.

10. A joint system according to claim 1 wherein the clamp leg of said U-shaped edge projects from said base parallel to said short side leg to form a corner transition, said locking strip means comprising a flat element extending diagonally relative to said body portion to afford engagement between said corner transition and said short side leg.

11. A joint system for structural panels, whereby at least one edge of a panel is constructed as a U-shaped edge designed to cooperate with a joint strip having a U-shaped cross section which grips around two adjacent U-shaped edges and locks these to one another, characterized in that each U-shaped edge comprises a short side leg spanning between the opposite surfaces of the panel and a base extending outward at a right angle from one edge of said side leg, a clamp leg spaced from the short side leg and having a projecting portion which is shorter and bent in toward the short side leg and each joint strip comprises a body portion, arms at the opposite edges thereof, and locking strip means extending toward the central area of the body portion, which locking strip means are designed to retain the joint profile in its location, a filler frame is provided between two of said panels, one of said panels being an inspection door, said filler frame having two U-shaped edges, and a joint strip connecting said filler frame to one of said two panels, and a locking rail is pivotally attached to said filler frame and is cooperable with the U-shaped edge of the other of said two panels to releasably interconnect the two panels.

12. A joint system for first and second structural panels, each panel having spaced opposite side wall surfaces, at least one edge of each panel being constructed as a U-shaped edge, a fastener for connecting said panels edges together, and a joint strip designed to cooperate with two adjacent edges of said first and second panels, said joint strip having a relatively flat U-shaped cross section which grips around said two adjacent U-shaped edges to cover said fastener and lock the panels to one another, characterized in that each U-shaped edge comprises a short side leg spanning between the opposite surfaces of the panel, a base extending outward at a right angle from one edge of said side leg, and a clamp leg spaced from the short side leg and having a projecting portion which is shorter and bent in toward the short side leg, said projecting portion being located in a plane parallel to and inside the plane of the adjacent side wall surface by a predetermined distance, said clamp leg and projecting portion forming a guideway between said portion and said short side leg, said guideway extending along the length of said one edge of the panel to slidably receive the joint strip, a sealing gasket is mounted at the outer side of at least one of the base and clamp leg of one panel to seal against at least one of the base and clamp leg of the adjacent panel, said gasket being held by said fastener, and each joint strip comprises a body portion of a thickness corresponding to said predetermined distance, arms extending perpendicular to said body and at the opposite edges thereof, said arms being approximately one-half of the width of the body and substantially the same width as said short side leg so that when the joint strip is in place within the guideway, the outer surface of the body portion is substantially coplanar with the adjacent side wall surface and locking strip means extending toward the central area of the body portion, the arm and locking strip means at each edge of the body portion being designed to slide longitudinally within the guideway of one U-shaped edge, said locking strip being of a width that the opposite edges of said locking strip may engage between said short side leg and said clamp leg to retain the one panel edge in its location.

* * * * *